US008313221B2

(12) United States Patent
Hsu

(10) Patent No.: US 8,313,221 B2
(45) Date of Patent: Nov. 20, 2012

(54) ILLUMINATING SYSTEM

(75) Inventor: Nien-Hui Hsu, Hsinchu (TW)

(73) Assignee: Young Green Energy Co., Hsinchu County (TW)

( * ) Notice: Subject to any disclaimer, the term of this patent is extended or adjusted under 35 U.S.C. 154(b) by 341 days.

(21) Appl. No.: 12/772,911

(22) Filed: May 3, 2010

(65) Prior Publication Data

US 2010/0295451 A1 Nov. 25, 2010

(30) Foreign Application Priority Data

May 25, 2009 (TW) ..... 98117274 A

(51) Int. Cl.
*F21V 29/00* (2006.01)

(52) U.S. Cl. ..... 362/373; 362/218; 362/276; 362/294

(58) Field of Classification Search ..... 362/218, 362/294, 276, 373
See application file for complete search history.

(56) References Cited

U.S. PATENT DOCUMENTS

| | | | | |
|---|---|---|---|---|
| 6,283,614 | B1 | 9/2001 | Okada et al. | |
| 6,340,237 | B1 | 1/2002 | Koga et al. | |
| 6,834,985 | B2 | 12/2004 | Chou et al. | |
| 7,510,285 | B2 * | 3/2009 | Takemi et al. | 353/61 |
| 7,583,498 | B2 * | 9/2009 | Chen et al. | 361/679.48 |
| 2010/0135025 | A1 * | 6/2010 | Chien et al. | 362/294 |
| 2011/0063832 | A1 * | 3/2011 | Hu et al. | 362/235 |

FOREIGN PATENT DOCUMENTS

| | | |
|---|---|---|
| TW | 535488 | 6/2003 |
| TW | 558179 | 10/2003 |
| TW | M287561 | 2/2006 |
| TW | M302719 U | 12/2006 |
| TW | 200734993 A | 9/2007 |
| TW | M350985 U | 2/2009 |
| TW | M353319 U | 3/2009 |

OTHER PUBLICATIONS

Taiwan Official Action issued Aug. 14, 2012 No. 098117274
Research Report issued May 25, 2009.

* cited by examiner

*Primary Examiner* — Stephen F Husar
*Assistant Examiner* — James Cranson, Jr.
(74) *Attorney, Agent, or Firm* — Chun-Ming Shih

(57) ABSTRACT

An illuminating system includes a system casing and a plurality of illuminating modules. The system casing has a first air-hole area and a plurality of second air-hole areas. One of the adjacent second air-hole areas keeping a first distance from each other keeps a second distance from the first air-hole area. The other one of the adjacent second air-hole areas keeps a third distance from the first air-hole area. The first distance is smaller than or equal to the second distance and smaller than or equal to the third distance. Each illuminating module disposed at the system casing includes a diversion casing having a third air-hole area and a fourth air-hole area. The third air-hole areas are located within the system casing and communicate with the first air-hole area. The adjacent second air-hole areas are respectively corresponding to and respectively communicate with the fourth air-hole areas of different illuminating modules.

8 Claims, 9 Drawing Sheets

ILLUMINATING SYSTEM

CROSS-REFERENCE TO RELATED APPLICATIONS

This application is based upon and claims the benefit of priority from the prior Taiwanese Patent Application No. 098117274, filed May 25, 2009, the entire contents of which are incorporated herein by reference.

BACKGROUND

1. Field of the Invention

The invention relates to an illuminating system and in particular, to the arrangement of air-hole areas of an illuminating system.

2. Description of the Prior Art

Referring to FIG. 1, the conventional illuminating system 100 includes a system casing 110 and an illuminating module 120. The system casing 110 has a first air inlet 112 and a first air outlet 114. The illuminating module 120 is disposed at the first air outlet 114.

The illuminating module 120 includes a diversion casing 122, a light source 124, a heat sink 126, and a fan 128. The diversion casing 122 has a second air inlet 122*a* and two second air outlets 122*b*. The second air outlets 122*b* are corresponding to the first air outlet 114, and the fan 128 is disposed at the second air inlet 122*a*. The light source 124 includes a printed circuit board 124*a* and a plurality of light emitting diode elements 124*b*. The light emitting diode elements 124*b* are disposed at one side of the printed circuit board 124*a* and electrically connected to the printed circuit board 124*a*.

The heat sink 126 is disposed at another side of the printed circuit board 124*a* and located within the diversion casing 122, and the heat sink 126 is thermally coupled to the printed circuit board 124*a*. The heat sink 126 includes a heat-dissipating plate 126*a* and a plurality of fins 126*b*. The printed circuit board 124*a* of the light source 124 is disposed at the heat-dissipating plate 126*a*. The fins 126*b* are disposed at the heat-dissipating plate 126*a*. Each of the fins 126*b* and the light source 124 are disposed at opposite sides of the heat-dissipating plate 126*a*, respectively. The fan 128 is disposed at the fins 126*b*.

When the illuminating system 100 operates normally, the light emitting diode elements 124*b* generate light and heat and the fan 128 operates to generate an airflow C1. The airflow C1 enters the system casing 110 through the first air inlet 112, then passes through the second air inlet 122*a*, the heat sink 126, and then leaves the system casing 110 through the second air outlets 122*b* and the first air outlet 114.

However, when the fan 128 breaks down, the heat generated by the light emitting diode elements 124*b* may not be efficiently dissipated to the outside environment. Therefore, the illuminating module 120 may be damaged because it is overheated.

BRIEF SUMMARY

The invention provides an illuminating system including a plurality of illuminating modules. When a fan of one of the illuminating modules breaks down, heat generated by the illuminating module during operation having the fan breaking down may still be dissipated by adjacent fan normally operating to the outside environment.

In order to achieve at least one of the objectives, an embodiment of the invention provides an illuminating system including a system casing and a plurality of illuminating modules. The system casing has a first air-hole area and a plurality of second air-hole areas. Adjacent two of the second air-hole areas keep a first distance apart from each other. One of the adjacent second air-hole areas keeping the first distance apart from each other keeps a second distance apart from the first air-hole area. The other one of the adjacent second air-hole areas keeping the first distance apart from each other keeps a third distance apart from the first air-hole area. The first distance is smaller than or equal to the second distance. The first distance is smaller than or equal to the third distance.

The illuminating modules are disposed at the system casing. Each of the illuminating modules includes a diversion casing, a light source, a heat sink, and a fan. The diversion casing has a third air-hole area and a fourth air-hole area. The light source is suitable for generating a light and the light is emitted outside the system casing. The heat sink is disposed within the diversion casing and thermally coupled to the light source. The fan is disposed at the third air-hole area and suitable for generating an airflow passing through the third air-hole area, the heat sink and the fourth air-hole area. The third air-hole areas are located within the system casing and communicate with the first air-hole area. One of the adjacent second air-hole areas keeping the first distance apart from each other is corresponding to and communicates with the fourth air-hole area of one of the illuminating modules. The other one of the adjacent two second air-hole areas keeping the first distance apart from each other is corresponding to and communicates with the fourth air-hole area of another of the illuminating modules.

As mentioned above, the embodiment or embodiments of the invention may have at least one of the following advantages. When the illuminating system of the embodiment of the invention abnormally operates, because the distance between the second air-hole area corresponding to the illuminating module with the fan abnormally operating and the second air-hole area corresponding to the adjacent illuminating module is smaller, the heat generated by the illuminating module during operation having the fan abnormally operating may still be dissipated by the adjacent fan normally operating to the outside environment. Accordingly, the light source of the illuminating module with the fan abnormally operating may not be overheated, and the life loss of the light source of the illuminating module with the fan abnormally operating decreases.

Other objectives, features and advantages of the invention will be further understood from the further technological features disclosed by the embodiments of the invention wherein there are shown and described preferred embodiments of this invention, simply by way of illustration of modes best suited to carry out the invention.

BRIEF DESCRIPTION OF THE DRAWINGS

The accompanying drawings are included to provide a further understanding of the embodiments of the invention, and are incorporated in and constitute part of this specification. The drawings illustrate embodiments of the invention and, together with the description, serve to explain the principles of the invention.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure(s) being described. The components of the invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Similarly, the terms "facing," "faces" and variations thereof herein are used broadly and encompass direct and indirect facing, and "adjacent to" and variations thereof herein are used broadly and encompass directly and indirectly "adjacent to". Therefore, the description of "A" component facing "B" component herein may contain the situations that "A" component facing "B" component directly or one or more additional components is between "A" component and "B" component. Also, the description of "A" component "adjacent to" "B" component herein may contain the situations that "A" component is directly "adjacent to" "B" component or one or more additional components is between "A" component and "B" component. Accordingly, the drawings and descriptions will be regarded as illustrative in nature and not as restrictive.

Figure 1:
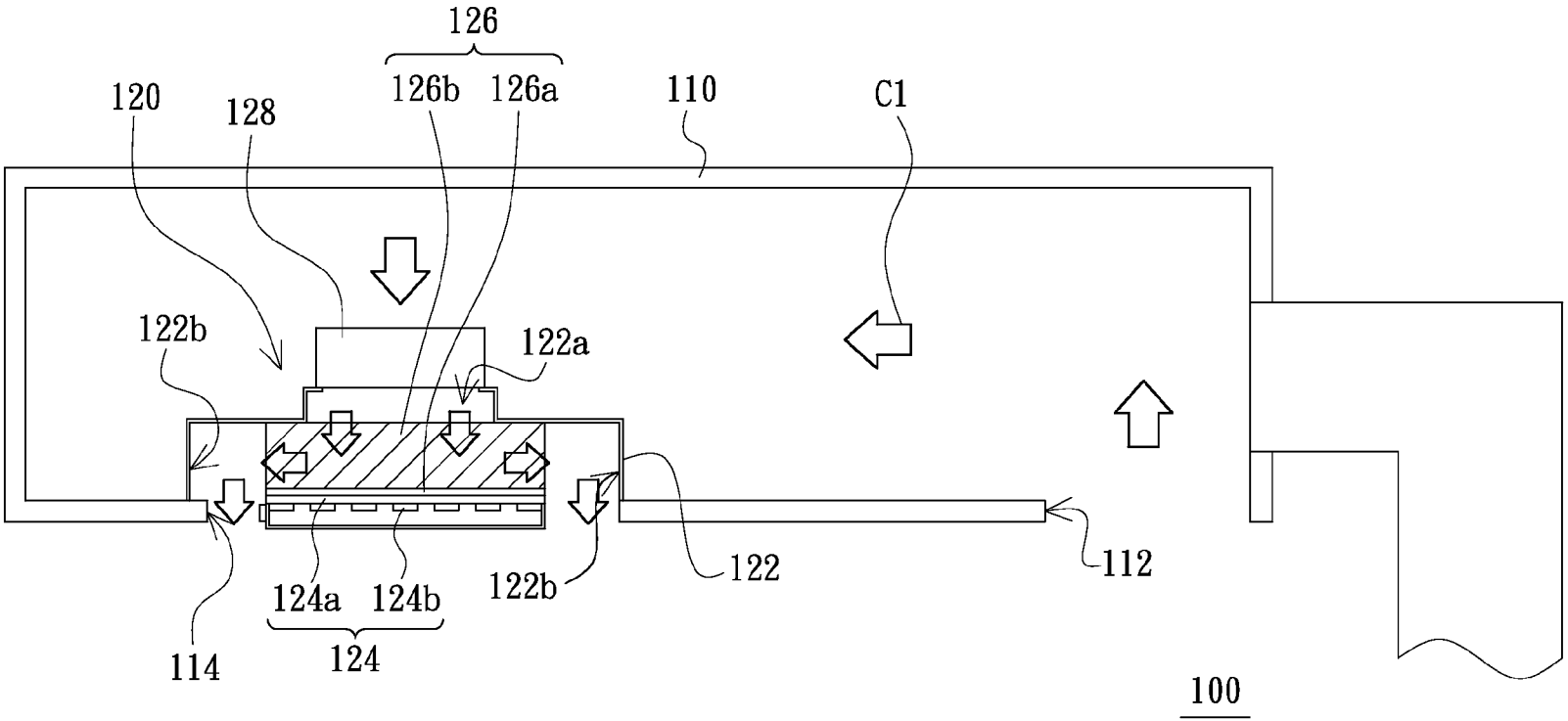
FIG. 1 (Prior Art)
FIG. 1 is a schematic cross-sectional view of a conventional illuminating system.
Figure 2:
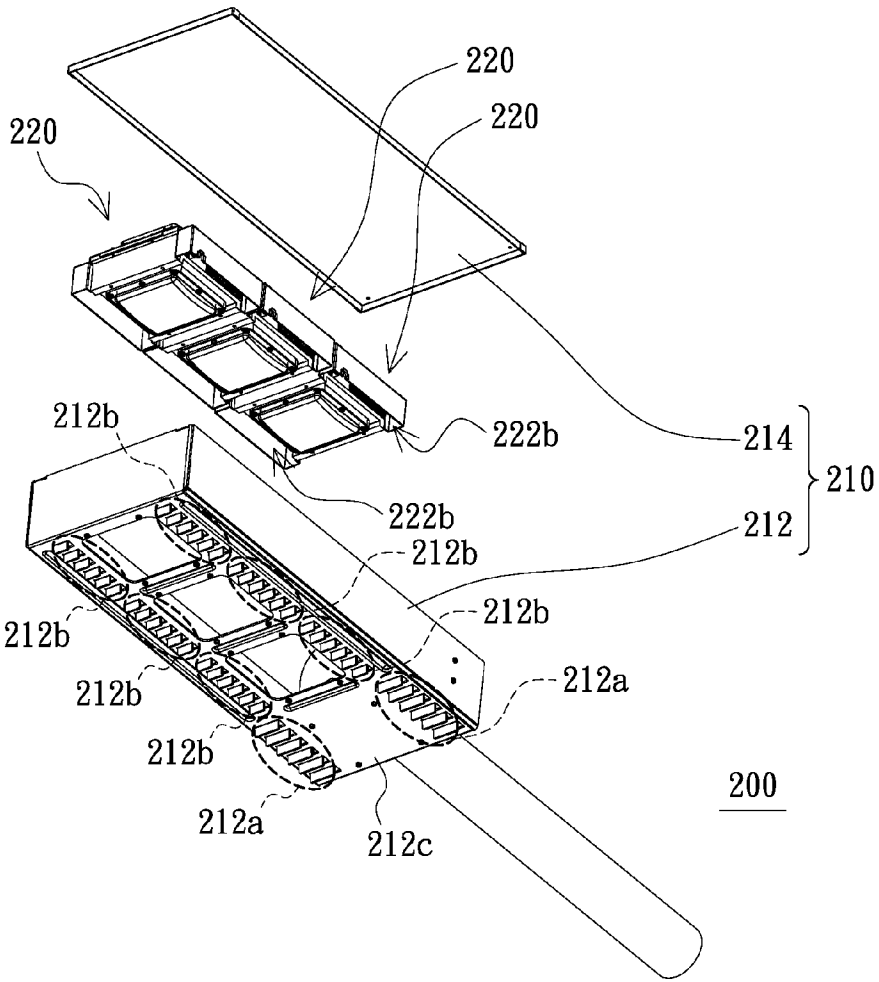
FIG. 2 is a schematic three-dimensional exploded view of an illuminating system according to a first embodiment of the invention.
Figure 3:
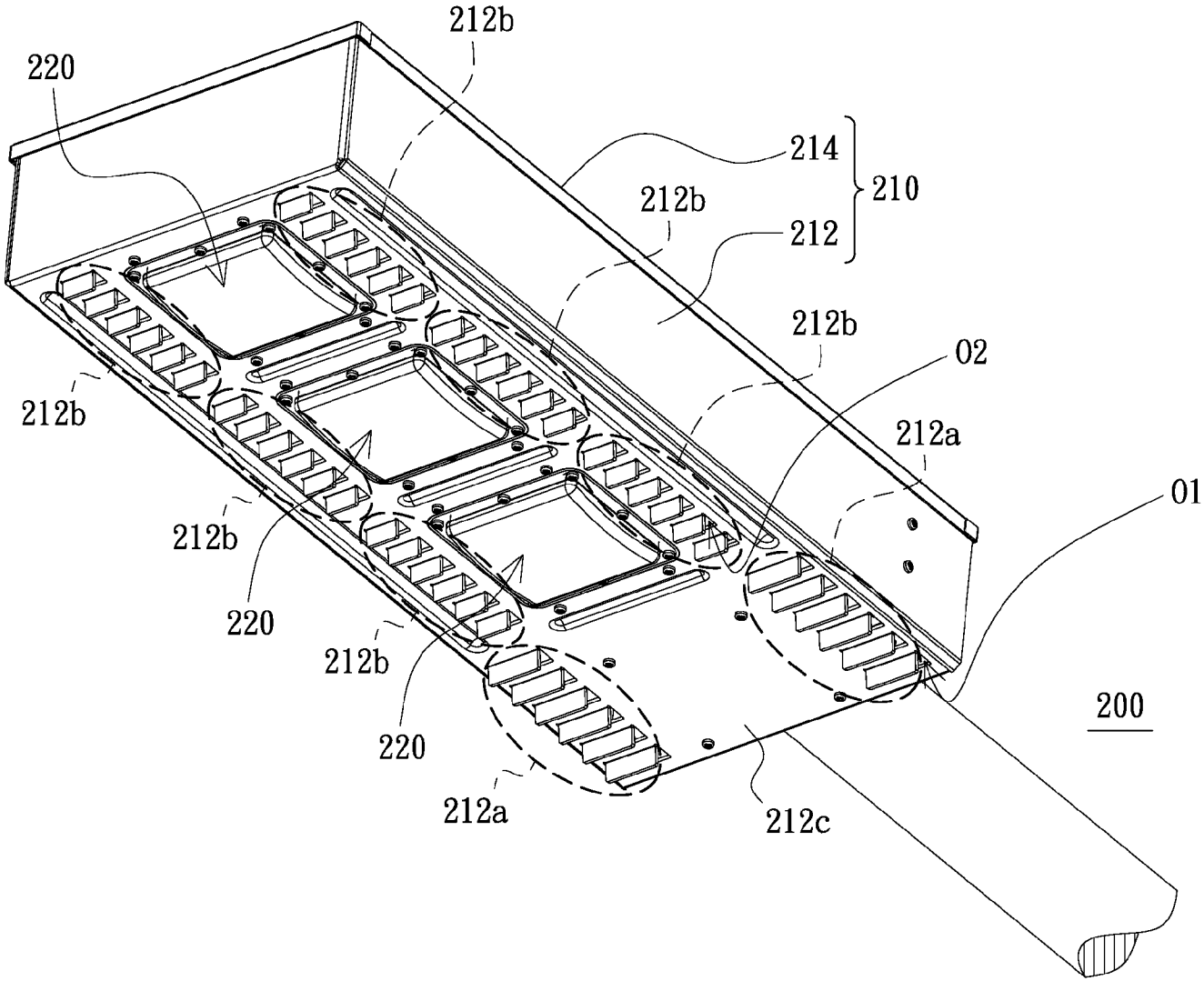
FIG. 3 is a schematic three-dimensional assembly view of the illuminating system of FIG. 2.
Figure 4:
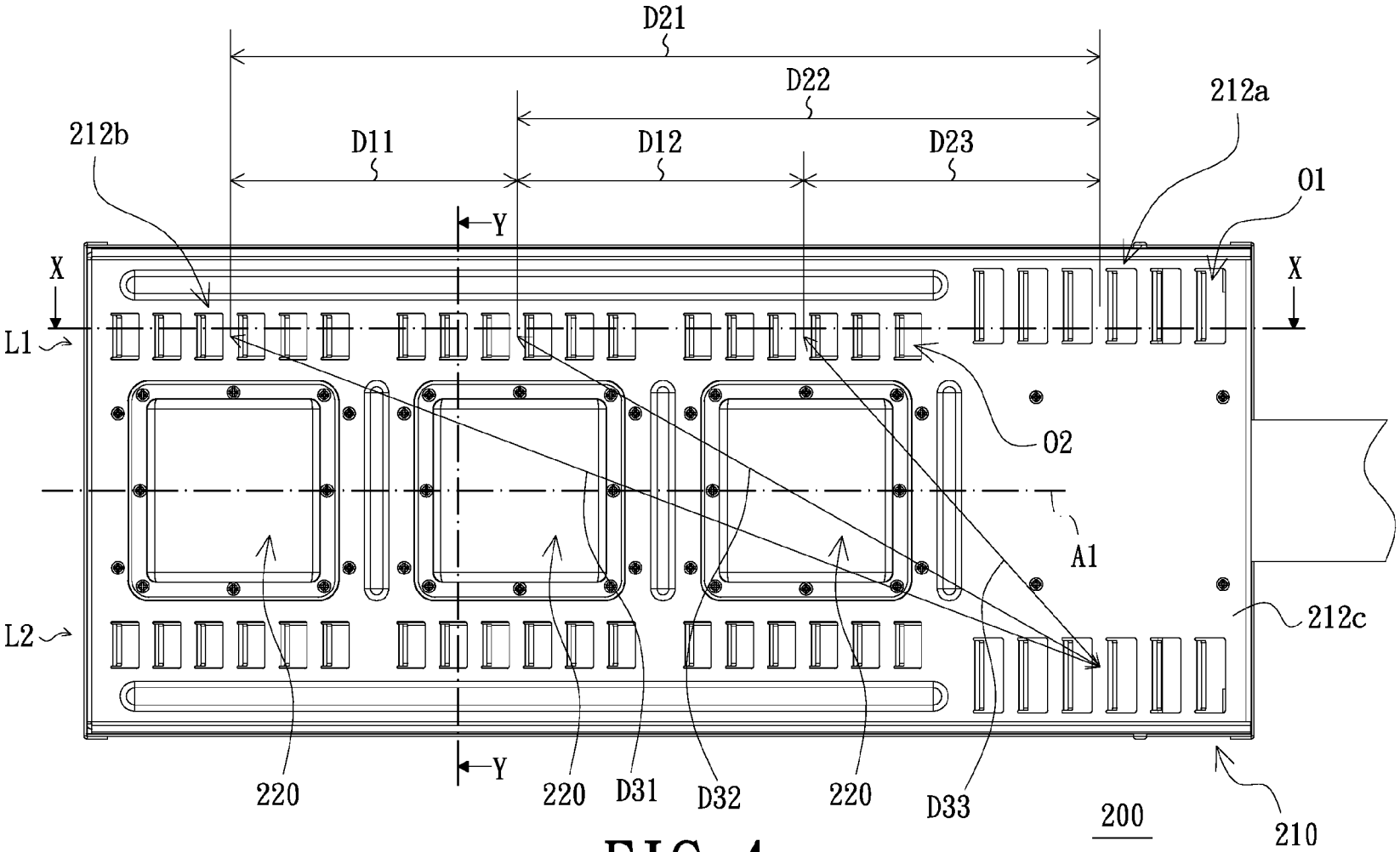
FIG. 4 is a schematic top view of the illuminating system of FIG. 3.
Figure 5:
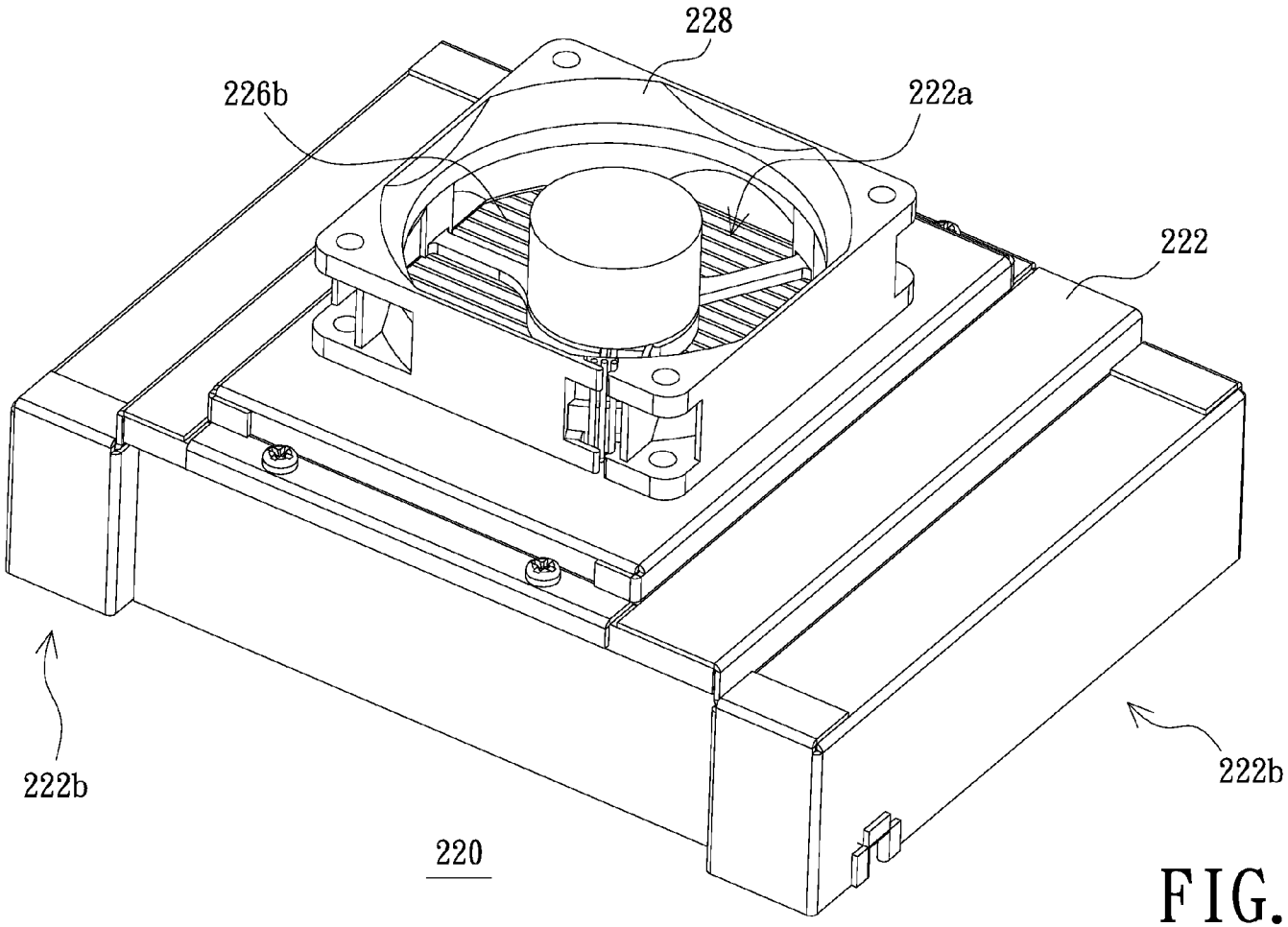
FIG. 5 is a schematic three-dimensional view of an illuminating module of FIG. 2.
Figure 6:
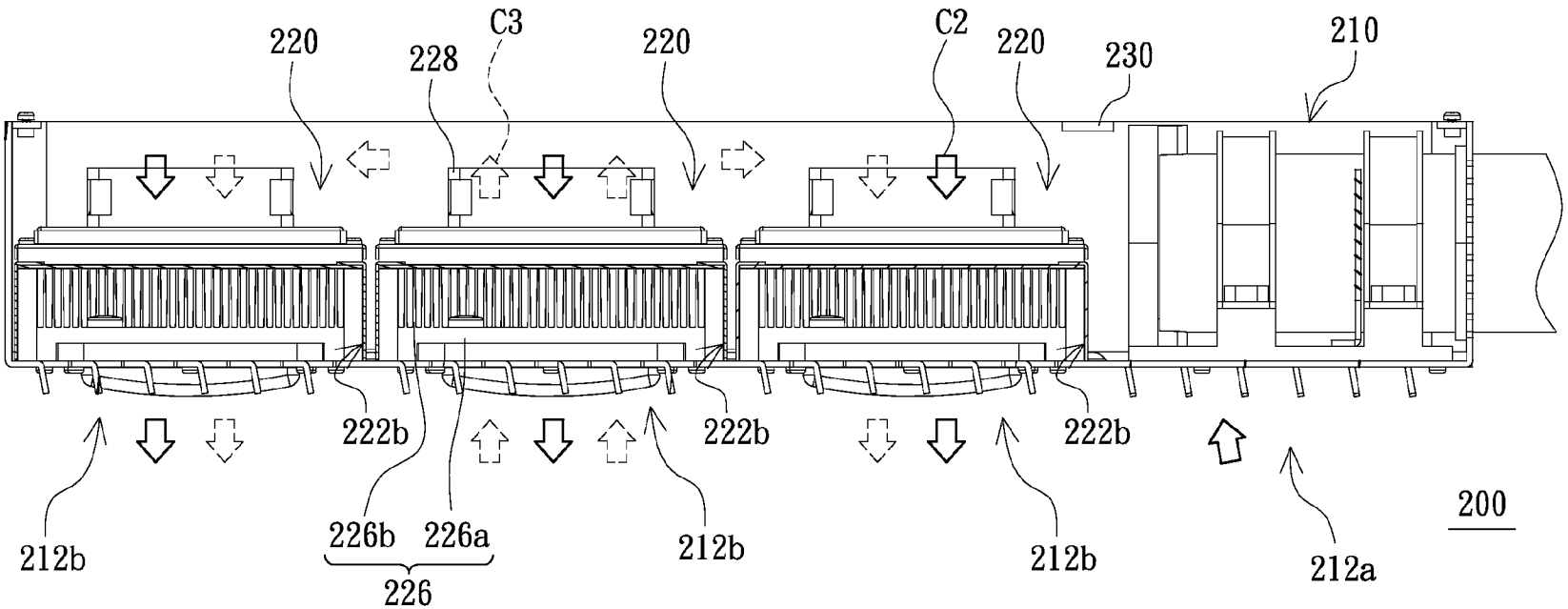
FIG. 6 is a schematic cross-sectional view of the illuminating system of FIG. 4 taken along the line X-X.
Figure 7:
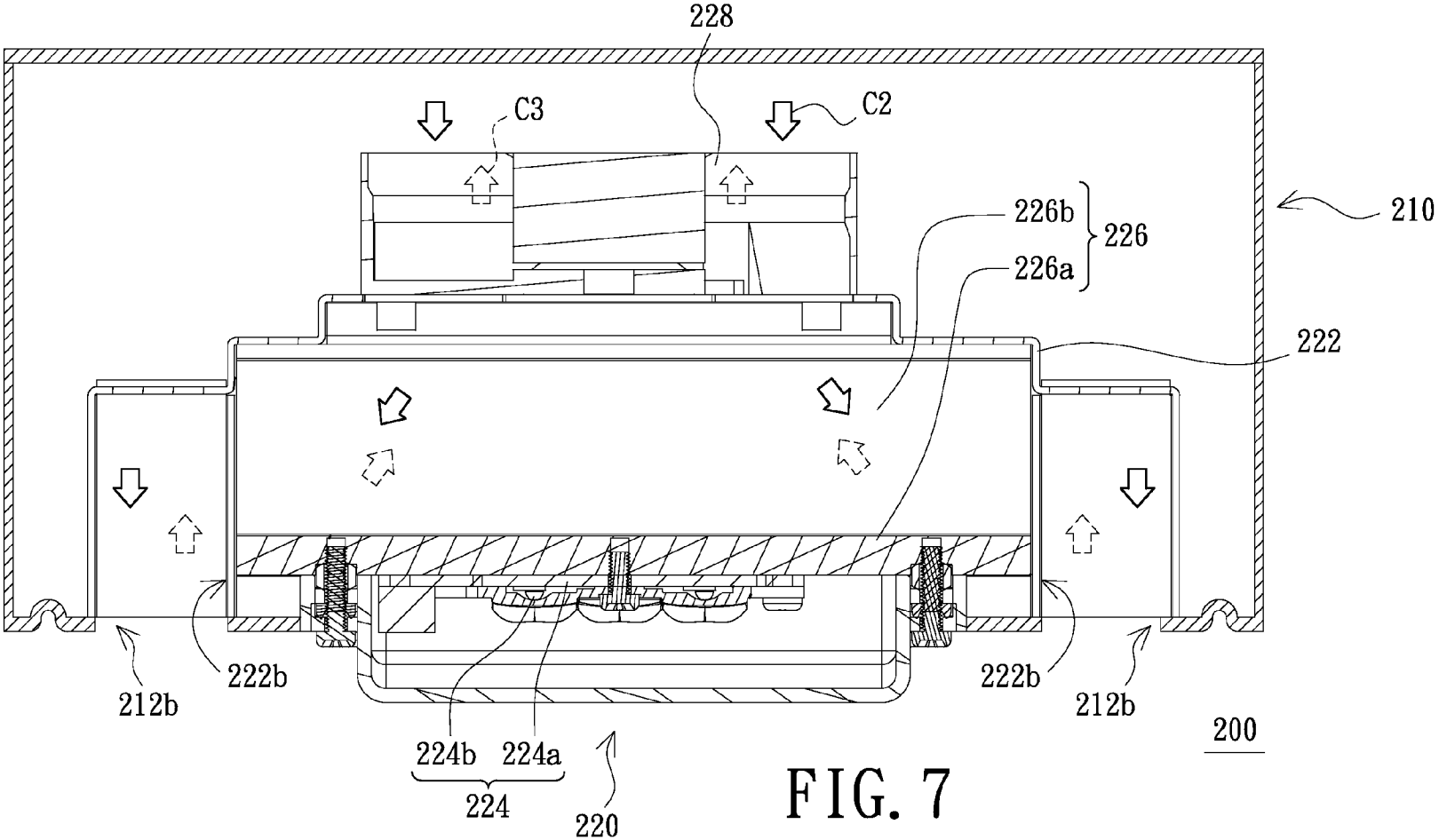
FIG. 7 is a schematic cross-sectional view of the illuminating system of FIG. 4 taken along the line Y-Y.
Figure 8:
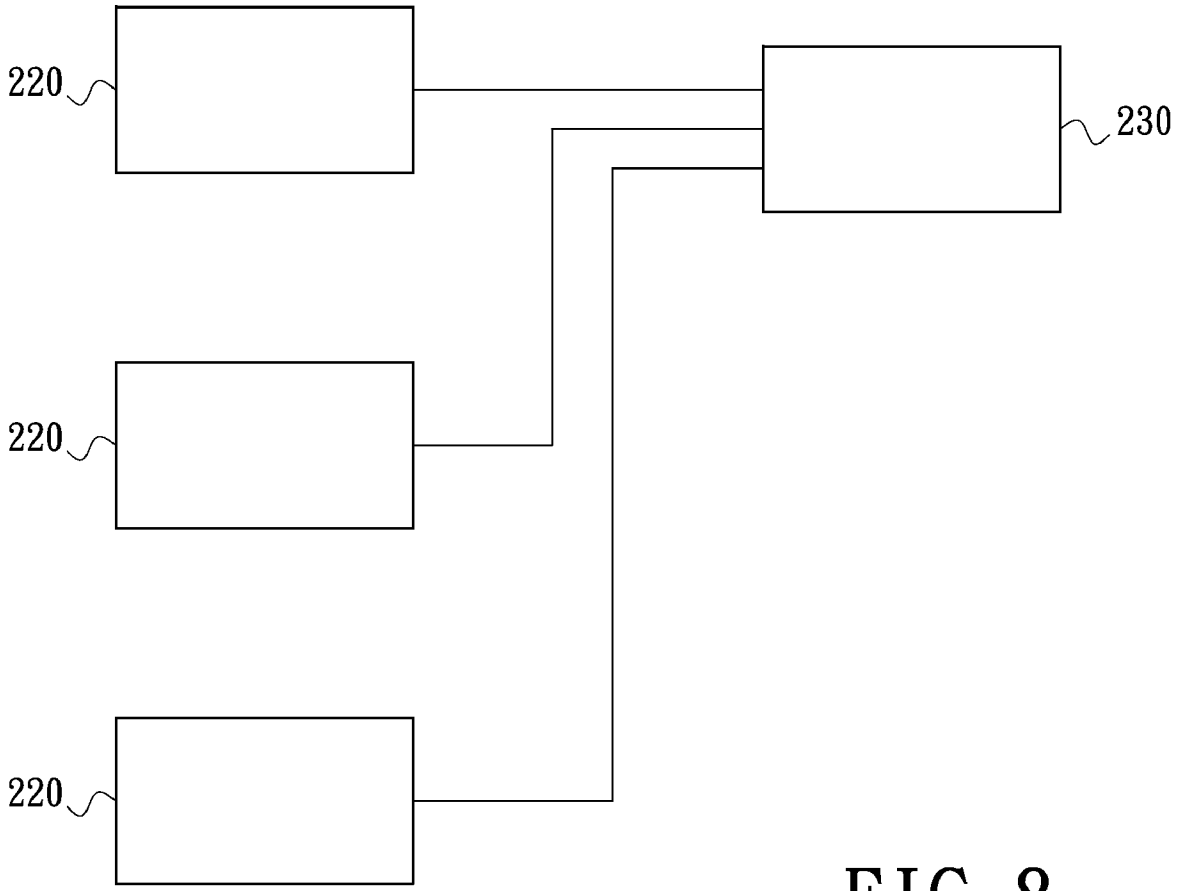
FIG. 8 is a circuit block diagram of a controlling device and the illuminating modules of FIG. 6.

Referring to FIGS. 2 to 4, the illuminating system 200 of the embodiment includes a system casing 210 and a plurality of illuminating modules 220. The system casing 210 includes a main body 212 and a top cover 214. The main body 212 has at least one first air-hole area 212*a*, a plurality of second air-hole areas 212*b*, and a bottom plate 212*c*. The bottom plate 212*c* is opposite to the top cover 214. Each of the first air-hole areas 212*a* has a plurality of first air-holes O1, and each of the second air-hole areas 212*b* has a plurality of second air-holes O2. The first air-holes O1 and the second air-holes O2 are disposed at the bottom plate 212*c* and pass through the bottom plate 212*c*. In the embodiment, the second air-hole areas 212*b* are arranged at opposite sides of an axis A1 and symmetrical to the axis A1. In addition, in the embodiment, two first air-hole areas 212*a* are taken as an example, and the first air-hole areas 212*a* are arranged at the opposite sides of the axis A1 and symmetrical to the axis A1.

The second air-hole areas 212*b* and the first air-hole areas 212*a* are arranged in a first row L1 and a second row L2 and the first row L1 and a second row L2 are parallel to each other. Each adjacent two of the second air-hole areas 212*b* in the first row L1 keep a distance D11 or D12 apart from each other. In the embodiment, the distance D11 is equal to the distance D12. Each of the second air-hole areas 212*b* in the first row L1 keeps another distance D21, D22, or D23 apart from the first air-hole area 212*a* in the first row L1. Each of the second air-hole areas 212*b* in the first row L1 keeps another distance D31, D32, or D33 apart from the first air-hole area 212*a* in the second row L2.

According to the relative position in FIG. 4, the relationships between the adjacent two second air-hole areas 212*b* in the first row L1 keeping the distance D11 apart from each other and the first air-hole areas 212*a* are taken for example. The distance D11 is smaller than the distance D21, the distance D11 is smaller than the distance D22, the distance D11 is smaller than the distance D31, and the distance D11 is smaller than the distance D32. The relationships between the adjacent two second air-hole areas 212*b* in the first row L1 keeping the distance D12 apart from each other and the first air-hole areas 212*a* are taken for example. The distance D12 is smaller than the distance D22, the distance D12 is smaller than or equal to the distance D23, the distance D12 is smaller than the distance D32, and the distance D12 is smaller than the distance D33.

Referring to FIGS. 2 to 7, the illuminating modules 220 are disposed at the system casing 210. Each of the illuminating modules 220 includes a diversion casing 222, a light source 224, a heat sink 226, and a fan 228. In each of the illuminating modules 220, the diversion casing 222 has a third air-hole area 222*a* and at least one fourth air-hole area 222*b*. The fan 228 is disposed at the third air-hole area 222*a*.

On the whole, the third air-hole areas 222*a* of the illuminating system 200 are located within the system casing 210 and communicate with the first air-hole areas 212*a*. In the embodiment, the fourth air-hole areas 222*b* of the illuminating system 200 are respectively corresponding to and respectively communicate with the second air-hole areas 212*b*.

Concretely, one of the adjacent two second air-hole areas 212*b* in the first row L1 keeping the distance D11 apart from each other is corresponding to and communicates with one of the fourth air-hole areas 222*b* of one of the illuminating modules 220. The other one of the adjacent two second air-hole areas 212*b* in the first row L1 keeping the distance D11 apart from each other is corresponding to and communicates with one of the fourth air-hole areas 222*b* of another of the illuminating modules 220. That is, the adjacent two second air-hole areas 212*b* in the first row L1 keeping the distance D11 apart from each other are corresponding to different illuminating modules 220, respectively.

In addition, one of the adjacent two second air-hole areas 212*b* of the first row L1 keeping the distance D12 apart from each other is corresponding to and communicates with one of the fourth air-hole areas 222*b* of one of the illuminating modules 220. The other one of the adjacent two second air-hole areas 212*b* of the first row L1 keeping the distance D12 apart from each other is corresponding to and communicates with one of the fourth air-hole areas 222*b* of another of the illuminating modules 220. That is, the adjacent two second air-hole areas 212*b* in the first row L1 keeping the distance D12 apart from each other are corresponding to different illuminating modules 220, respectively.

In each of the illuminating modules 220, the light source 224 includes a printed circuit board 224*a* and a plurality of light emitting elements 224*b* such as light emitting diode elements. The light emitting elements 224*b* are disposed at one side of the printed circuit board 224*a* and electrically connected to the printed circuit board 224*a*. The light generated by the light emitting elements 224*b* is emitted outside the system casing 210.

In each of the illuminating modules 220, the heat sink 226 is disposed at another side of the printed circuit board 224*a* and located within the diversion casing 222. The heat sink 226 is thermally coupled to the printed circuit board 224*a* of the light source 224. The heat sink 226 includes a heat-dissipating plate 226*a* and a plurality of fins 226*b*. The printed circuit board 224*a* of the light source 224 is disposed at the heat-dissipating plate 226*a*. The fins 226*b* are disposed at the heat dissipating plate 226*a*. Each of the fins 226*b* and the light source 224 are disposed at opposite sides of the heat-dissipating plate 226*a*, respectively. The fan 228 such as an axial fan is disposed at the fins 226*b*. The fan 228 and the light source 224 are disposed at opposite sides of the heat sink 226, respectively.

Referring to FIG. 4 and FIGS. 6 to 8, the illuminating system 200 further includes a controlling device 230 and the controlling device 230 is electrically connected to the illuminating modules 220. The controlling device 230 is suitable for detecting the operation state of the fan 228 of each of the illuminating modules 220 so as to control the illumination brightness of the light source 224 of each of the illuminating modules 220.

When all the fans 228 normally operate, the illuminating system 200 normally operates. Meanwhile, the controlling device 230 detects the operation state of each of the fans 228 such that the illumination brightness of the light emitting elements 224*b* of each of the light sources 224 keeps a normal output value. The fan 228 of each of the illuminating modules 220 generates an airflow C2 sequentially passing through the corresponding third air-hole area 222*a*, the corresponding heat sink 226 and the corresponding fourth air-hole areas 222*b*. The airflows C2 pass through the first air-hole areas 212*a* to enter the system casing 210, and the airflows C2 pass through the second air-hole areas 212*b* to leave the system casing 210. The abovementioned descriptions are indicated by hollow arrows enclosed by solid lines shown in FIGS. 6 and 7.

When one of the fans 228 abnormally operates, that is, one of the fans 228 breaks down, the illuminating system 200 abnormally operates. In the embodiment, the fan 228 breaking down is, for example, located between the other two fans 228 normally operating. Meanwhile, the controlling device 230 detects the operation state of each of the fans 228 such that the illumination brightness of the light emitting elements 224*b* corresponding to the fan 228 breaking down is lowered, and the illumination brightness of other light emitting elements 224*b* keeps the normal output value.

In addition, when the illuminating system 200 abnormally operates, because the distances between one of the second air-hole areas 212*b* corresponding to the illuminating module 220 with the fan 228 abnormally operating (the illuminating module 220 with the fan 228 abnormally operating are called abnormal illuminating module 220 thereinafter for short) and one of the second air-hole areas 212*b* corresponding to the adjacent illuminating module 220 is smaller, an airflow C3 may be generated in the abnormal illuminating module 220. The airflow C3 in the abnormal illuminating module 220 sequentially passes through the corresponding second air-hole areas 212*b*, the corresponding fourth air-hole areas 222*b*, the corresponding heat sink 226, and the corresponding third air-hole area 222*a*. The abovementioned descriptions are indicated by hollow arrows enclosed by broken lines shown in FIGS. 6 and 7. Therefore, the heat generated by the abnormal illuminating module 220 during operation may be dissipated by the adjacent fans 228 normally operating to the outside environment. Accordingly, the light source 224 of the abnormal illuminating module 220 may not be overheated, and the life loss of the light source 224 of the illuminating module 220 with the fan 228 abnormally operating decreases.

Figure 9:
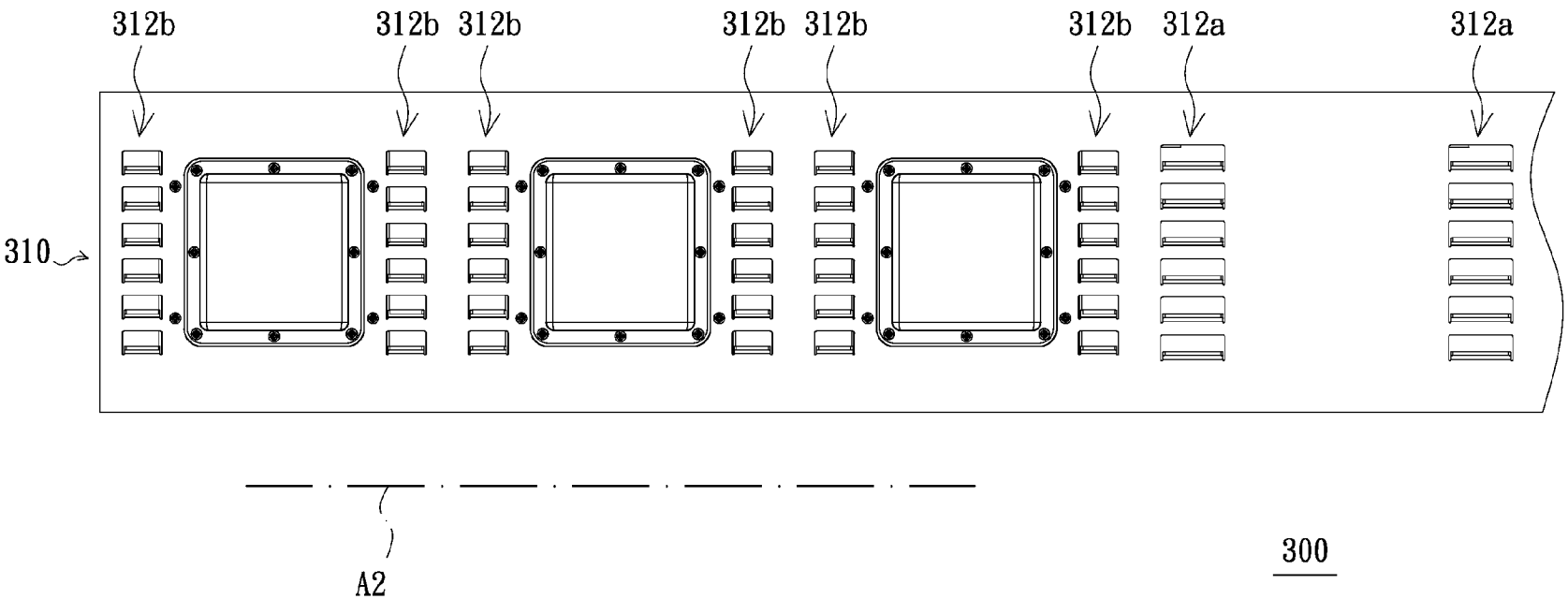
FIG. 9 is a schematic top view of an illuminating system according to a second embodiment of the invention.

Referring to FIG. 9, the difference between the illuminating system 300 of the embodiment and the illuminating system 200 of the first embodiment is that the first air-hole areas 312*a* and the second air-hole areas 312*b* of the system casing 310 of the embodiment are sequentially arranged along an axis A2.

As mentioned above, the embodiment or embodiments of the invention may have at least one of the following advantages.

1. When the illuminating system of the embodiment of the invention abnormally operates, because the distance between the second air-hole area corresponding to the illuminating module with the fan abnormally operating and the second air-hole area corresponding to the adjacent illuminating module, is smaller. Therefore, the heat generated by the illuminating module during operation having the fan abnormally operating may still be dissipated by the adjacent fan normally operating to the outside environment. Accordingly, the light source of the illuminating module with the fan abnormally operating may not be overheated, and the life loss of the light source of the illuminating module with the fan abnormally operating decreases.

2. The controlling device of the illuminating system of the embodiment of the invention are suitable for detecting the operation state of fan of each of the illuminating modules so as to control the illumination brightness of the light source of each of the illuminating modules. Therefore, when the illuminating system of the embodiment of the invention abnormally operates, the light source of the illuminating module with the fan abnormally operating may not be overheated, and the life loss of the light source of the illuminating module with the fan abnormally operating decreases.

The foregoing description of the preferred embodiment of the invention has been ed for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the invention" or the like is not necessary limited the claim scope to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the invention as defined by the following claims. Moreover, no element and component in the disclosure is intended to be dedicated to the public regardless of whether the element or component is explicitly recited in the following claims.

What is claimed is:

1. An illuminating system comprising:

a system casing, having a first air-hole area and a plurality of second air-hole areas, wherein adjacent two of the second air-hole areas keep a first distance apart from each other, one of the adjacent second air-hole areas keeping the first distance apart from each other keeps a second distance apart from the first air-hole area, the other one of the adjacent second air-hole areas keeping the first distance apart from each other keeps a third distance apart from the first air-hole area, the first distance is smaller than or equal to the second distance, and the first distance is smaller than or equal to the third distance; and a plurality of illuminating modules, disposed at the system casing, wherein each of the illuminating modules comprises:

a diversion casing, having a third air-hole area and a fourth air-hole area;

a light source, capable of generating a light beam emitted outside the system casing;

a heat sink, disposed within the diversion casing and thermally coupled to the light source; and a fan, disposed at the third air-hole area and capable of generating an airflow passing through the third air-hole area, the heat sink, and the fourth air-hole area;

wherein the third air-hole areas are located within the system casing and communicate with the first air-hole area, one of the adjacent second air-hole areas keeping the first distance apart from each other is corresponding to and communicates with the fourth air-hole area of one of the illuminating modules, the other one of the adjacent second air-hole areas keeping the first distance apart from each other is corresponding to and communicates with the fourth air-hole area of another of the illuminating modules.

2. The illuminating system as claimed in claim 1, wherein the second air-hole areas are symmetrical to an axis and located at opposite sides of the axis.

3. The illuminating system as claimed in claim 1, wherein the first air-hole areas and the second air-hole areas are sequentially arranged along an axis.

4. The illuminating system as claimed in claim 1, wherein the fan and the light source of each of the illuminating modules are disposed at opposite sides of the heat sink, respectively.

5. The illuminating system as claimed in claim 1, wherein the heat sink of each of the illuminating modules comprises:

a heat-dissipating plate, wherein the light source is disposed on the heat-dissipating plate; and a plurality of fins, disposed on the heat dissipating plate, wherein each of the fins and the light source are disposed at opposite sides of the heat-dissipating plate, respectively.

6. The illuminating system as claimed in claim 5, wherein the fan of each of the illuminating modules is disposed on the fins.

7. The illuminating system as claimed in claim 1, wherein each of the fans is an axial fan.

8. The illuminating system as claimed in claim 1, further comprising a controlling device electrically connected to the illuminating modules, wherein the controlling device is capable of detecting the operation state of the fan of each of the illuminating modules so as to control the illumination brightness of the light source of each of the illuminating modules.

* * * * *